US006710527B2

(12) United States Patent
Kobayashi et al.

(10) Patent No.: US 6,710,527 B2
(45) Date of Patent: Mar. 23, 2004

(54) CATHODE RAY TUBE WITH SLIT IN DEAD SPACE OF SHADOW MASK

(75) Inventors: Hiroshi Kobayashi, Osaka (JP); Yoshikazu Demi, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/911,170

(22) Filed: Jul. 23, 2001

(65) Prior Publication Data

US 2002/0014821 A1 Feb. 7, 2002

(30) Foreign Application Priority Data

Aug. 4, 2000 (JP) ..... 2000-236739

(51) Int. Cl.[7] ..... H01J 29/80

(52) U.S. Cl. ..... 313/402; 313/403; 313/407; 313/408

(58) Field of Search ..... 313/402, 403, 313/407, 408, 477 R, 479

(56) References Cited

U.S. PATENT DOCUMENTS

| | | | | |
|---|---|---|---|---|
| 3,766,419 A | * | 10/1973 | Barbin | 313/348 |
| 4,385,256 A | * | 5/1983 | Tokita et al. | 313/407 |
| 4,859,901 A | * | 8/1989 | Thompson-Russell | 313/403 |
| 4,942,333 A | * | 7/1990 | Knox | 313/402 |
| 5,128,224 A | * | 7/1992 | Ohtake et al. | 430/5 |
| 6,097,142 A | | 8/2000 | Ko | 313/402 |
| 6,140,754 A | * | 10/2000 | Ko | 313/407 |
| 6,175,185 B1 | * | 1/2001 | Aibara | 313/402 |
| 6,242,855 B1 | * | 6/2001 | Caronna et al. | 313/402 |
| 6,259,194 B1 | * | 7/2001 | Ito et al. | 313/402 |

FOREIGN PATENT DOCUMENTS

| | | |
|---|---|---|
| DE | 36 01 662 | 7/1986 |
| EP | 0 372 630 | 6/1990 |
| EP | 1 126 500 | 8/2001 |
| FR | 2151051 | 8/1997 |
| GB | 2 238 423 | 5/1991 |
| JP | 5-314920 | 11/1993 |
| JP | 11-265665 | 9/1999 |
| TW | 301757 | 4/1997 |

* cited by examiner

*Primary Examiner*—Nimeshkumar D. Patel
*Assistant Examiner*—Kevin Quarterman
(74) *Attorney, Agent, or Firm*—Merchant & Gould, P.C.

(57) ABSTRACT

Due to a slit formed in the dead space, a cathode ray tube capable of preventing incorrect hitting of color electron beams caused by the local doming phenomenon from occurring and thus preventing displacement of colors, unevenness in colors, and deterioration of luminance from occurring is provided. The cathode ray tube comprises a shadow mask having an effective area where lines of apertures for passing electron beams are arranged and a dead space formed on both outer sides of the effective area. In the dead space, a slit extending along the lines of the apertures is formed. Accordingly, the thermal expansion of the dead space caused by a temperature increase can be reduced, and the stress applied to the aperture line of the effective area adjacent to the dead space can be suppressed. As a result, the local doming phenomenon can be prevented from occurring.

5 Claims, 6 Drawing Sheets

CATHODE RAY TUBE WITH SLIT IN DEAD SPACE OF SHADOW MASK

FIELD OF THE INVENTION

The present invention relates to a cathode ray tube having a shadow mask, which is used for a television receiver, a computer display, and the like.

BACKGROUND OF THE INVENTION

FIG. 5 is a cross-sectional view showing one example of a conventional color cathode ray tube. A color cathode ray tube 1 shown in FIG. 5 includes a substantially rectangular-shaped face panel 2 having a phosphor screen 2*a* on its inner face, and a funnel 3 connected to the rear side of the face panel 2. An electron gun 4 is contained in a neck portion 3*a* of the funnel 3, and a deflection yoke 5 is provided on the outer periphery of the funnel 3 in order to deflect and scan electron beams.

Furthermore, a shadow mask 6 is provided, opposed to the phosphor screen 2*a*, and a color-selecting electrode 9 is formed by fixing the shadow mask 6 to a pair of mask frames 7 held by a support 8. 10 indicates a track of electron beams.

The shadow mask 6 has a flat plate provided with a number of apertures formed by etching, through which electron beams pass, and plays a role of selecting colors with respect to three electron beams emitted from the electron gun 4.

In a color cathode ray tube, due to the thermal expansion caused by the impact of the emitted electron beams, the electron beam through apertures are shifted. Consequently, a doming phenomenon occurs. That is, the electron beams passing through the electron beam through apertures fail to hit a predetermined phosphor correctly, thus causing unevenness in colors. Therefore, a tension force to absorb the thermal expansion due to the temperature increase of the shadow mask 6 is applied in advance, and then the shadow mask 6 is stretched and held to the mask frame 7.

When the shadow mask 6 is stretched and held as mentioned above, even if the temperature of the shadow mask 6 is raised, it is possible to reduce the amount of displacement between an aperture of the shadow mask 6 and phosphor stripes of the phosphor screen 2*a*.

However, the conventional color cathode ray tube suffers from the following problem. FIG. 6 is a perspective view of the color-selecting electrode 9 shown in FIG. 5. The shadow mask 6 is stretched and held to the mask frame 7 in a state in which the tension force is applied in the direction indicated by arrow Y. The shadow mask 6 has an effective area 11, in which a number of apertures 13 serving as electron beam through apertures are formed, and a dead space 12 on both sides in a horizontal direction thereof. In the effective area 11, the apertures 13 are neighboring in the vertical direction (vertical direction of the screen) via a bridge 14 and arranged in lines. Furthermore, the dead space has a width and a curvature at the end portions to some degree so that an appropriate tension distribution is provided over the shadow mask.

With regard to the shadow mask 6 illustrated in FIG. 6, due to the thermal expansion of the shadow mask 6 caused by the impact of the emitted electron beams, for example, in an area 15, which is a portion between the horizontally neighboring aperture lines, stress is applied in the direction indicated by arrows a. When such stress is applied, wrinkles are created in the area 15 and the aperture 13 is shifted in the horizontal direction. When such a so-called local doming phenomenon occurs, electron beams do not hit the shadow mask correctly, thus causing displacement of colors, unevenness in colors, and deterioration of luminance.

In addition, since the apertures are not formed in the dead space 12, the degree of the thermal expansion in the dead space is larger than that in the effective area 11 where the apertures 13 are formed, and thus, the aperture line adjacent to the dead space 12 is shifted by the difference of this thermal expansion. Therefore, the aperture lines adjacent to the area 12 have a larger degree of movement due to the local doming phenomenon.

Such a local doming phenomenon could not be prevented sufficiently even by stretching and holding the shadow mask as described above.

SUMMARY OF THE INVENTION

It is an object of the present invention to solve the conventional problem described above by forming a slit in the dead space of a cathode ray tube for preventing incorrect hitting of color electron beams caused by the local doming phenomenon from occurring and thus preventing displacement of colors, unevenness in colors, and deterioration of luminance from occurring.

To achieve the above object, a cathode ray tube of the present invention comprises a shadow mask having an effective area and a dead space formed on both outer sides of said effective area in a horizontal direction, a plurality of aperture lines having a plurality of apertures for passing electron beams being arranged via a bridge in said effective area, and the shadow mask being stretched and held in a vertical direction, wherein a slit extending along said aperture line is formed in said dead space. According to the cathode ray tube described above, the thermal expansion can be absorbed in the slit portion, so that the stress applied to the aperture line of the effective area adjacent to the dead space can be suppressed.

In the aforementioned cathode ray tube, it is preferable that a horizontal width of said slit is from 45% to 100% of a horizontal width of said aperture adjacent to said dead space. According to the cathode ray tube described above, a drastic difference is eliminated between the mechanical strength in the dead space and the mechanical strength in the effective area, so that it is possible to prevent bridges from tearing in the vicinity of the dead space or wrinkles from arising in the shadow mask.

Furthermore, it is preferable that a vertical length of said slit is equal to or longer than a vertical length of said aperture adjacent to said dead space. According to the cathode ray tube described above, the thermal expansion can be absorbed more surely by the slit.

Furthermore, it is preferable that said slit includes a slit having inclined faces opposed to each other via an opening, the inclined faces being formed at an inclined angle such that light beams of electron beams entering said dead space are blocked. According to the cathode ray tube described above, the light beams of the electron beams are blocked in a portion where the slit is formed, so that as far as the passing of the light beams is concerned, it is substantially the same as the shadow mask in which slits are not formed.

Furthermore, it is preferable that an electron shield is disposed for blocking said electron beams and thus preventing said electron beams from reaching said dead space. According to the cathode ray tube described above, since the electron beams do not hit the dead space directly, it is possible to suppress a temperature increase of the shadow mask.

DETAILED DESCRIPTION OF THE INVENTION

Figure 1:
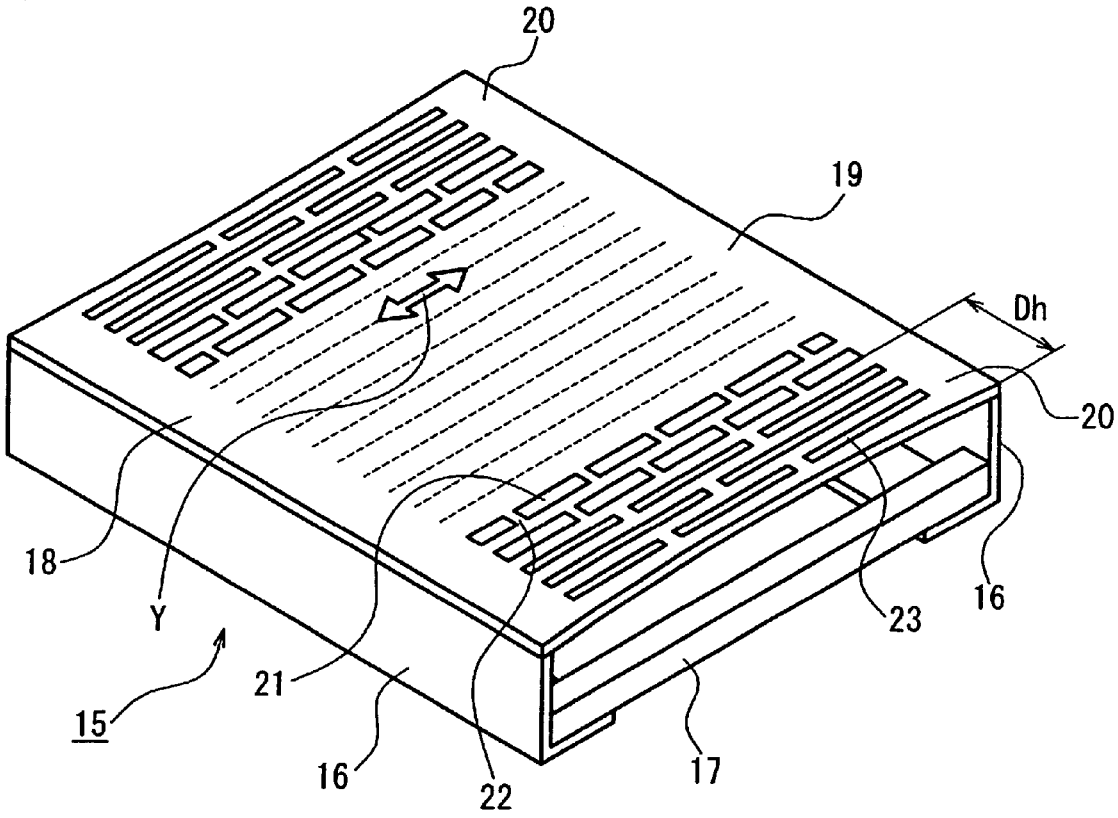
FIG. 1 is a perspective view showing a color-selecting electrode according to an embodiment of the present invention.

Hereinafter, one embodiment of the present invention will be described with reference to the drawings. FIG. 1 is a perspective view showing an embodiment of a color-selecting electrode. A color-selecting electrode 15 shown in FIG. 1 is a rectangular frame including a pair of elastic members 17 serving as short frames fixed to a pair of supports 16 opposed to each other serving as long frames, and the shadow mask 18 is fixed thereto by welding or the like. In the shadow mask 18, an area indicated with 19 is an effective area, and an area indicated with 20 a dead space.

In the effective area 19, substantially slot-shaped apertures 21 serving as electron beam through apertures are formed by etching. The apertures 21 neighboring in the vertical direction are linked by a bridge 22. A tension method is employed for the shadow mask shown in this drawing, and the shadow mask 18 is stretched and held between the supports 16 with a tension force applied mainly in the direction indicated by arrow Y.

Figure 2:
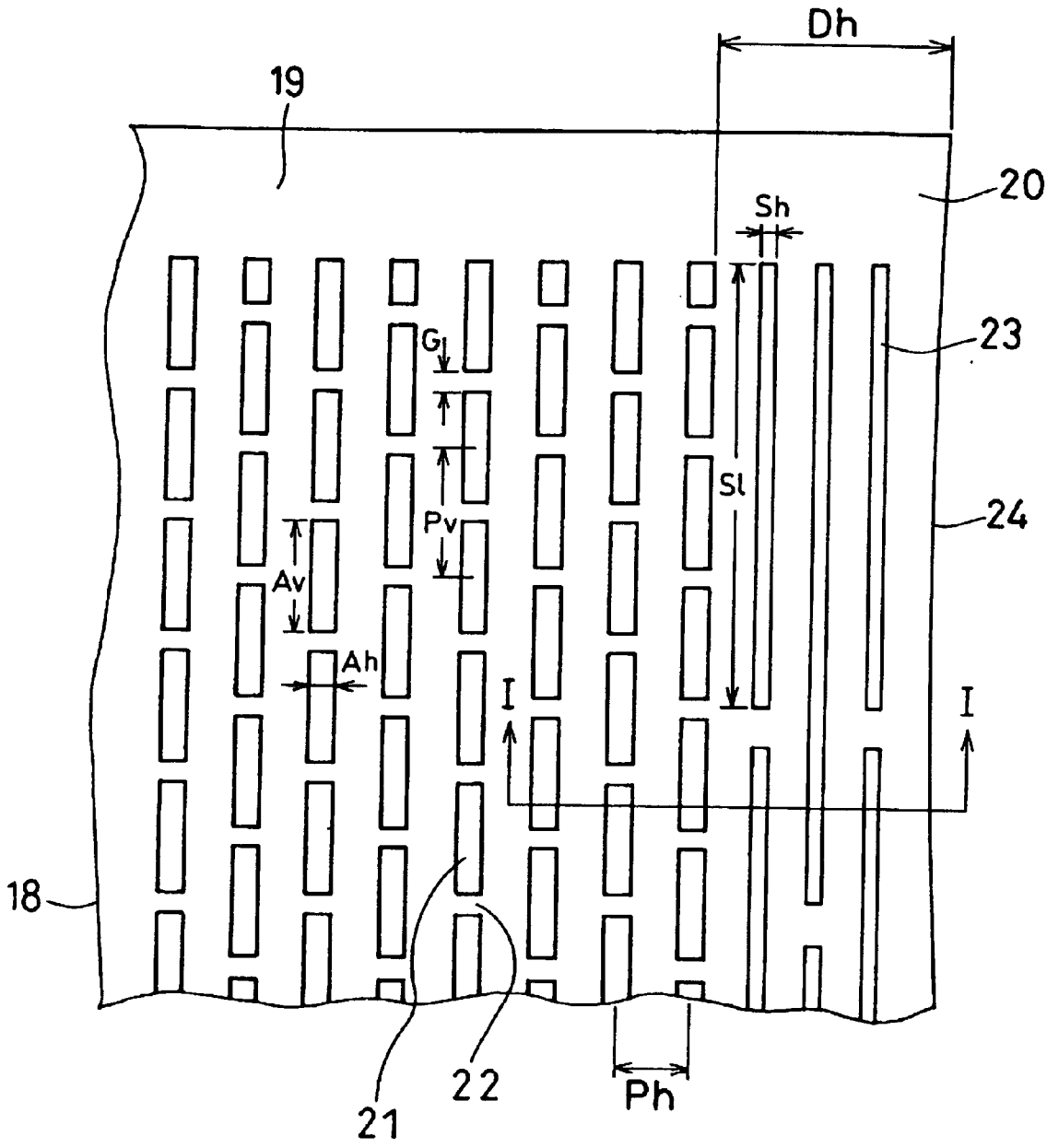
FIG. 2 is a plan view showing a shadow mask according to an embodiment of the present invention.

FIG. 2 is a plan view showing a part of the shadow mask 18 shown in FIG. 1. In the present embodiment, as a shadow mask used for a cathode ray tube having a screen with a diagonal size of 60 cm and an aspect ratio (length:height) of 4:3, it is determined such that a thickness of the shadow mask is 0.13 mm, a vertical pitch Pv of the electron beam through aperture in the effective area is 10 mm to 11 mm, and a bridge width G is about 0.06 mm. Furthermore, with respect to the size of the electron beam through aperture, a vertical diameter Av and a horizontal diameter Ah are determined respectively to be 0.56 mm and 0.19 mm approximately in the center of the effective area, while the vertical diameter Av and the horizontal diameter Ah are determined respectively to be 0.55 mm and 0.20 mm in the vicinity of the dead space.

Horizontal end portions 24 of the dead space 20 are formed as curves having a curvature radius of 2500 mm, and a width Dh of the dead space in the vertical end portion is determined to be 13 mm. Furthermore, the dead space 20 has a slit 23 arranged in three lines, and a width Sh and a length Sl of the slit are determined respectively to be 0.10 mm and about 30 mm. In addition, the slits are formed at an interval which is almost the same as a horizontal pitch Ph of the electron beam through apertures in the vicinity of the dead space, and this interval is determined here to be about 1 mm.

Thus, since the slit 23 is provided in the dead space 20, the thermal expansion of the dead space 20 can be divided and absorbed by each slit 23. In other words, by forming the slit 23, the thermal expansion of the dead space 20 can be absorbed by the dead space itself, so that the amount of thermal expansion of the dead space as a whole can be suppressed to a low level. Therefore, it is possible to suppress the stress applied to the aperture line adjacent to the dead space 20 caused by the thermal expansion of the dead space 20.

Generally, in the shadow mask having bridges in each aperture line, the stress is transmitted horizontally via the bridges, thereby easily causing a displacement of electron beam through apertures. By suppressing the stress applied to the aperture line by the slits of the dead space as in the present embodiment, the displacement of colors caused by the displacement of electron beam through apertures can be prevented from occurring.

Furthermore, by forming the slits in the dead space as in the present embodiment, a drastic difference between the mechanical strength in the effective area and the mechanical strength in the dead space can be eliminated. Generally, in the shadow mask having bridges, even if a tension is applied only in a vertical direction, an additional tension actually occurs also in a horizontal direction. When a drastic difference in the mechanical strength arises between the dead space and the effective area, the bridges may be torn or wrinkles may be created in the vicinity of the dead space in the shadow mask. The present embodiment prevents such tears and wrinkles from occurring. In addition, it is preferable that a width of the slit is set to be from 45% to 100% with respect to a horizontal diameter of the neighboring electron beam through apertures in order to achieve an optimal mechanical strength.

Furthermore, due to the fact that the slit loses its function to absorb the thermal expansion when a vertical length of the slit is too short, it is preferable that the vertical length is equal to or longer than the vertical dimension of the electron beam through aperture in the effective area. Moreover, the slit may be such a long slit that the vertical length of the slit is equal to the vertical dimension of the effective area in the shadow mask. However, it is important to form the slit so that the slit is not deformed to have a greatly broadened width by the tension distribution. Therefore, for example, it is preferred to lessen the curvature of the curved dead space end portion. The curvature radius R of the end portion is set to be about 3200 mm when the diagonal size of the screen is 56 cm, while the curvature radius is set to be about 10000 mm when the diagonal size of the screen is 80 cm.

Furthermore, three lines of slits were formed in the present embodiment, but one line of slit also is possible. However, it is most effective to form as many lines as possible in the dead space.

Furthermore, it is preferable that a range of forming slits in the dead space in the vertical direction is within a range of the effective area (area where apertures are formed) in the vertical direction. Thereby, the mechanical strength between the shadow mask and the long frame (support 16) in the vicinity of the welded spot is not damaged, so that a desired tension distribution can be secured.

Figure 3:
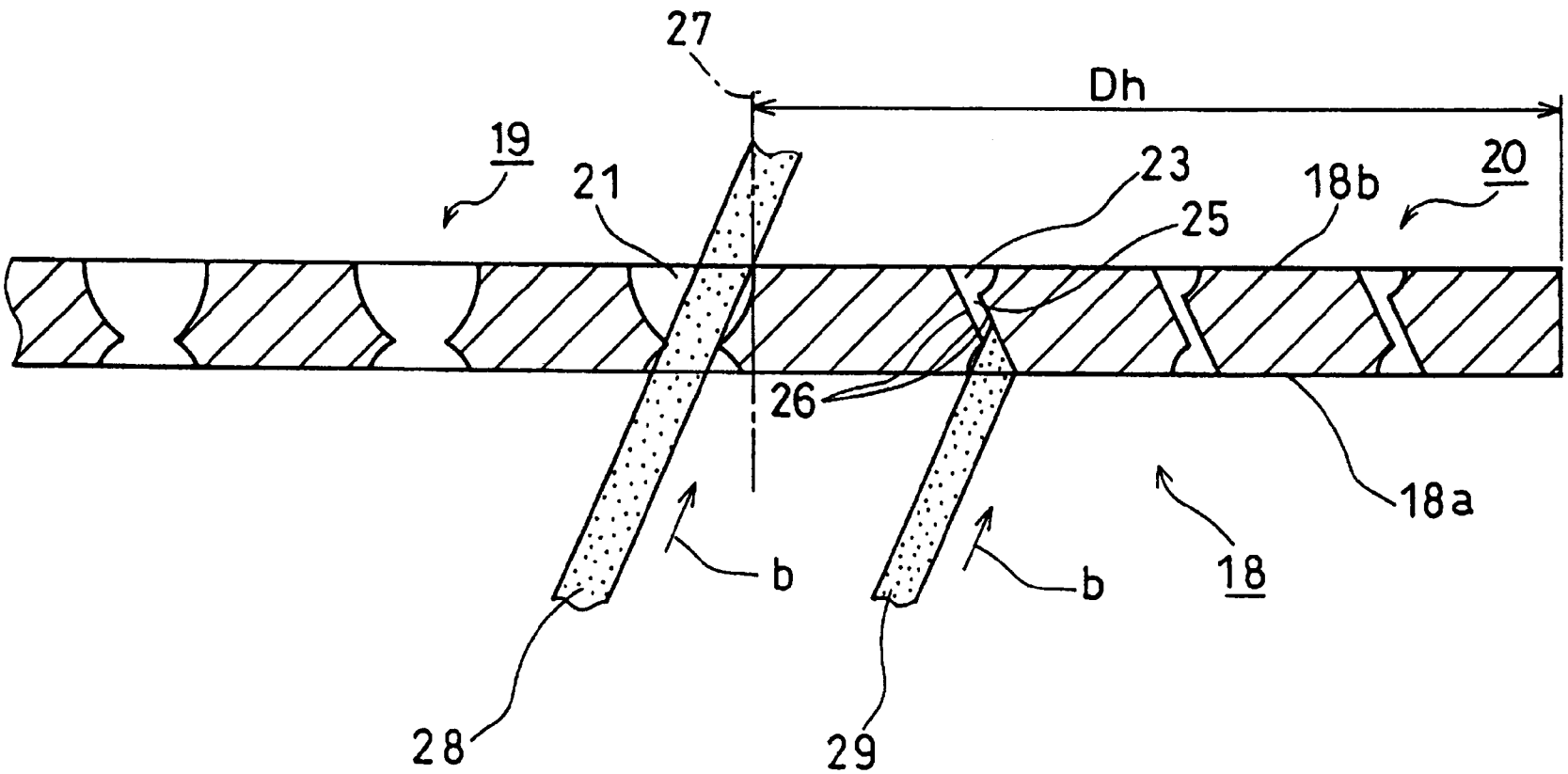
FIG. 3 is a cross-sectional view showing a shadow mask according to an embodiment of the present invention.

FIG. 3 shows a cross-sectional view taken on line I—I of FIG. 2. As shown in FIG. 3, the slit 23 formed in the dead space 20 has inclined faces 26 opposed to each other via an opening 25. The direction of inclination of the inclined faces 26 is a direction of inclining toward the side of a border 27 between the effective area 19 and the dead space 20 as it approaches from a rear face 18*a* to a front face 18*b* of the shadow mask 18.

In addition, although it is not shown in FIG. 3, slits with inclined faces opposed to each other via an opening are formed also in the other dead space 20, and the direction of inclination of the inclined faces is a direction of inclining toward the side of the border between the effective area 19 and the dead space 20 as it approaches from the rear face 18*a* to the front face 18*b* of the shadow mask 18.

As shown in FIG. 3, light beams 28, 29 of the electron beams advance in the direction indicated by arrow b. In this case, the light beam 28 in the effective area 19 passes through the aperture 21, but the light beam 29 in the dead space 20 is blocked by the inclined faces 26 of the slit 23. This configuration is the same in the other dead space 20.

In other words, according to the present embodiment, although the slit 23 is formed in the dead space 20, the light beams of the electron beams are blocked in a portion where the slit 23 is formed. Therefore, as far as the passing of the light beams is concerned, it is substantially the same as the shadow mask in which slits are not formed. As a result, it is possible to prevent the electron beams from passing through the slits and unnecessarily hitting the phosphor screen or other places.

Additionally, the slit 23 in FIG. 3 was explained by referring to the case in which the slit penetrates completely from the front face to the rear face of the shadow mask, but there also may be a minute connected portion formed in the opening for linking the opposed inclined faces. Also in this case, the effect of absorbing stress can be achieved, and light is blocked surely.

Moreover, the inclined angle of the slit is not limited to the embodiment illustrated in FIG. 3. The inclined angle may be determined suitably in a range in which stress can be absorbed and electron beams can be blocked. For example, the slit may be formed with vertical faces opposed to each other.

Figure 4:
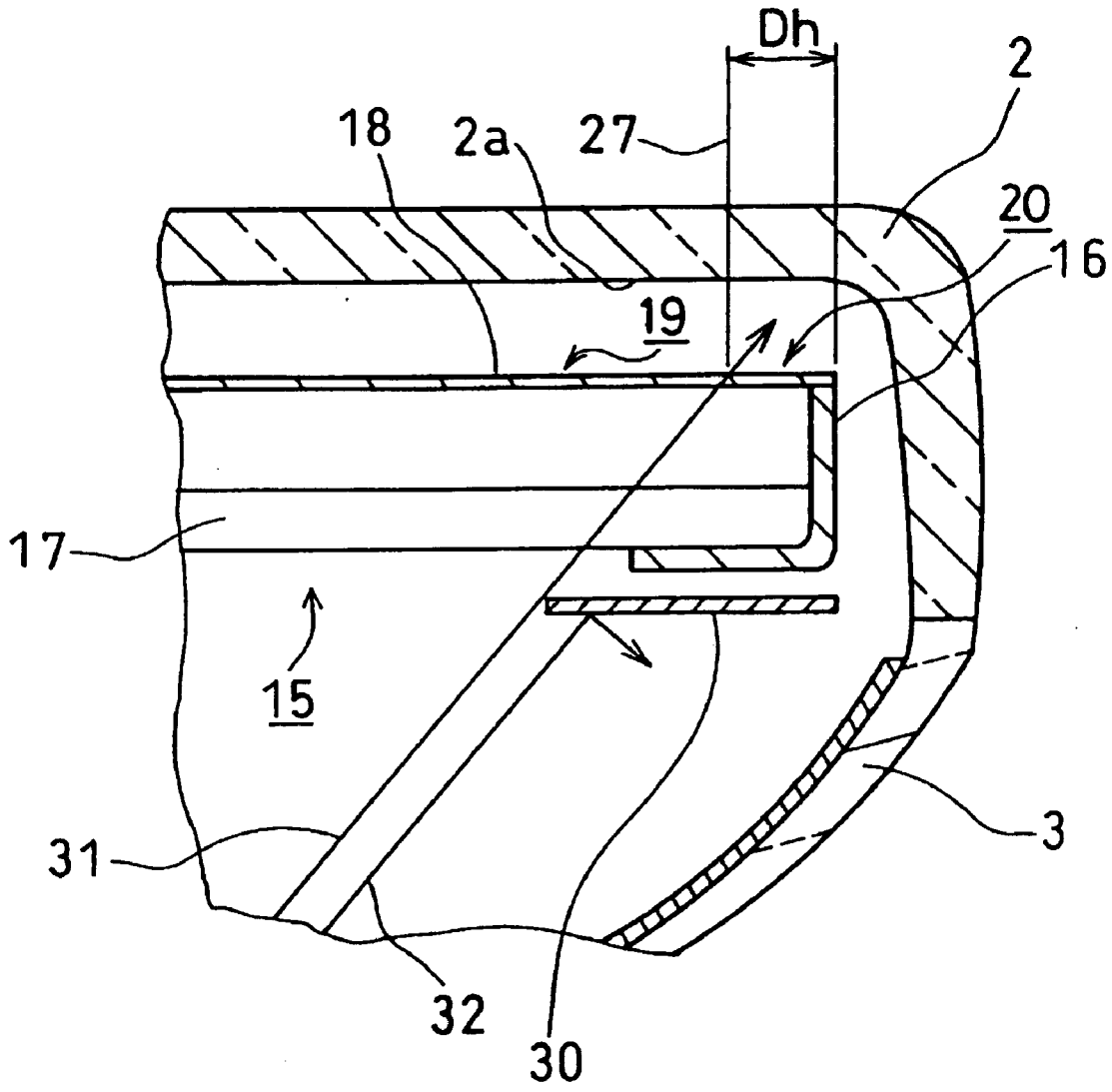
FIG. 4 is a cross-sectional view showing a part of a cathode ray tube according to an embodiment of the present invention.
Figure 5:
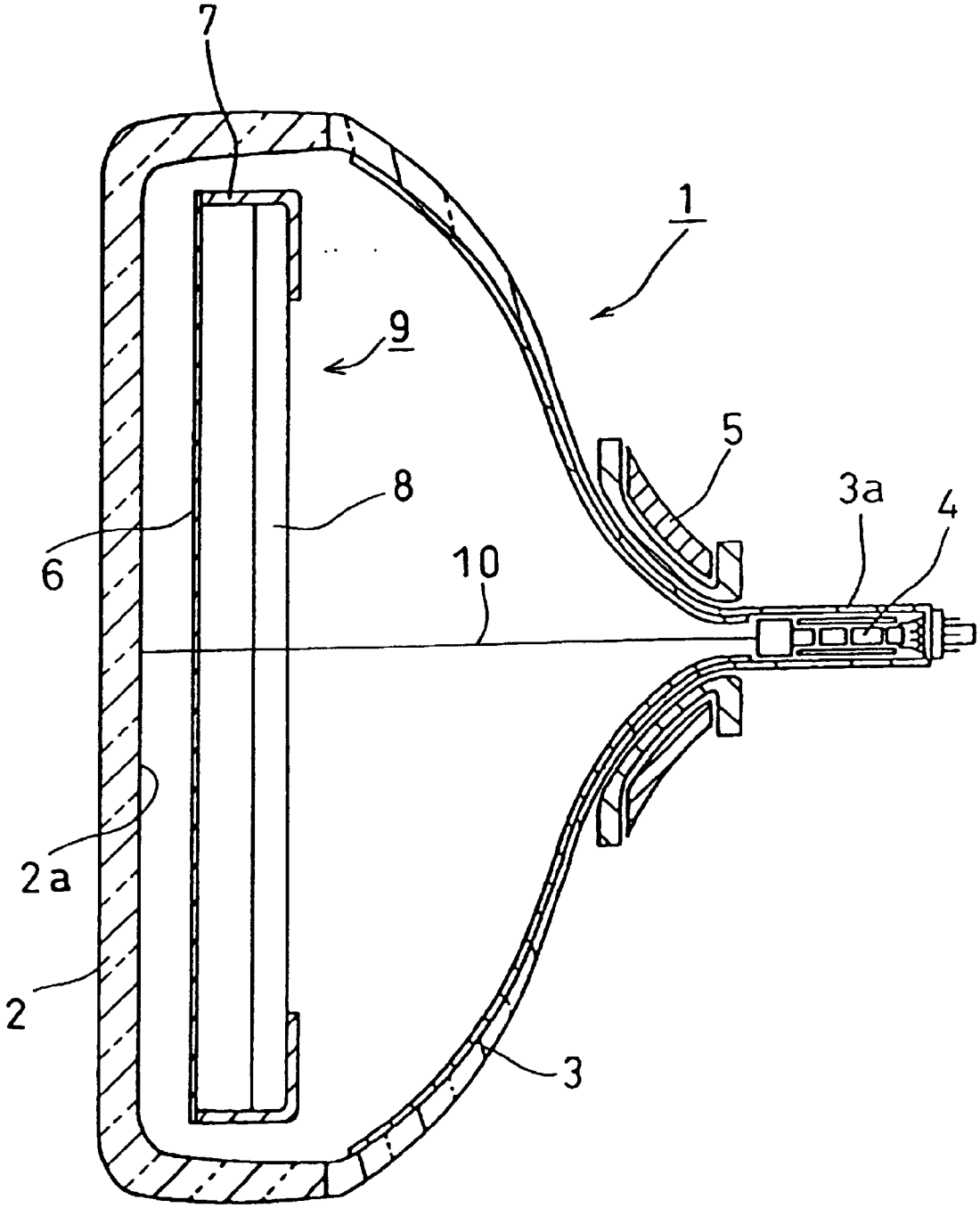
FIG. 5 PRIOR ART
FIG. 5 is a cross-sectional view showing an example of a color cathode ray tube.
Figure 6:
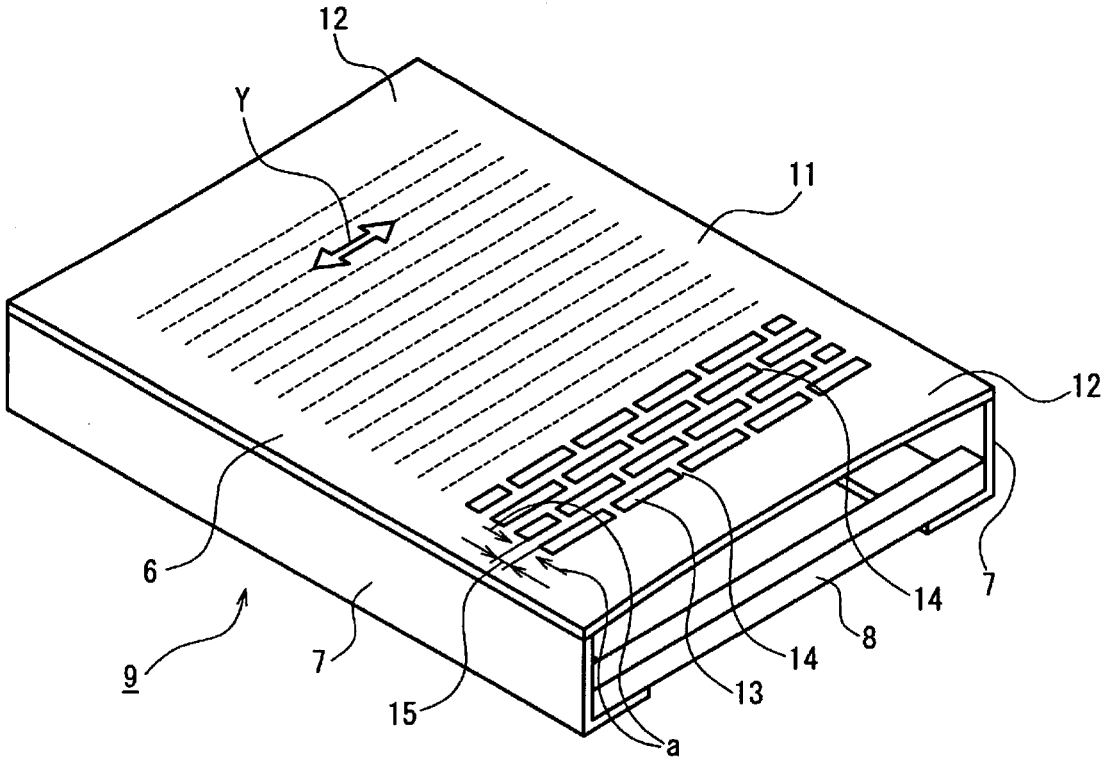
FIG. 6 PRIOR ART
FIG. 6 is a perspective view showing an example of a conventional color-selecting electrode.

FIG. 4 is a partial cross-sectional view of a color cathode ray tube according to the present embodiment. The face panel 2, the phosphor screen 2*a*, and the funnel 3 are constructed in the same manner as shown in FIG. 6.

The cathode ray tube illustrated in FIG. 4 is equipped with the color-selecting electrode 15 shown in FIG. 1 and also an electron shield 30. As indicated by a line 31, the electron beams reach as far as the border 27 between the effective area 19 and the dead space 20, but as indicated by a line 32, the electron beams are blocked by the electron shield 30, thereby not reaching the dead space 20. Therefore, since the electron beams do not hit the dead space 20 directly, a temperature increase in the dead space 20 can be suppressed.

Accordingly, although the electron beams do not hit the dead space 20 directly due to the electron shield 30, a part of the electron beams emitted to the effective area 19 and reflected irregularly hits the dead space 20. Even in this case, since slits are formed in the dead space 20 as described above in the shadow mask 18, the thermal expansion of the dead space 20 can be reduced when the temperature is raised, thereby also preventing the local doming phenomenon from occurring.

Furthermore, the present embodiment showed an example of a slot-shaped electron beam through aperture, but it is not limited hereto. The electron beam through aperture may be oval, ellipse, or shaped such that a plurality of protrusions are projecting from the long side of a slot-shaped aperture to the inside. In addition, a pitch and a size thereof also are not limited to the above values and are changed appropriately according to a diagonal size of the screen, resolution etc. of the cathode ray tube.

As described above, according to the cathode ray tube of the present invention, it is possible to suppress the stress applied to the aperture lines of the electron beam through apertures caused by the thermal expansion of the dead space in the shadow mask and also to suppress the occurrence of the local doming phenomenon.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube comprising a shadow mask, the shadow mask being fixed to a support, the shadow mask including:

an effective area in which a plurality of aperture lines having a plurality of apertures for passing electron beams are arranged via a bridge, and a dead space formed on both outer sides of said effective area in a direction perpendicular to a direction in which the aperture lines are directed, and the shadow mask being stretched and held, with a tension force being applied in the direction in which the aperture lines are directed, wherein the shadow mask is fixed to the support at both ends of the shadow mask in the direction in which the tension force is applied, and has unfixed open ends, that are ends thereof in a direction perpendicular to the direction in which the tension force is applied, a slit extending along said aperture line is formed in said dead space formed on both outer sides of said effective area in the direction perpendicular to the direction in which the aperture lines are directed, and the slit has a lengthwise direction that coincides with the direction in which the aperture lines are directed.

2. The cathode ray tube according to claim 1, wherein a width of said slit in the direction perpendicular to the direction in which the aperture lines are directed is from 45% to 100% of a width in the same direction of said aperture adjacent to said dead space.

3. The cathode ray tube according to claim 1, wherein a length of said slit in the direction in which the aperture lines are directed is equal to or longer than a length in the same direction of said aperture adjacent to said dead space.

4. The cathode ray tube according to claim 1, wherein said slit includes a slit having inclined faces opposed to each other via an opening, the inclined faces being formed at an inclined angle such that light beams of electron beams entering said dead space are blocked.

5. The cathode ray tube according to claim 1, further comprising an electron shield disposed for blocking electron beams from reaching said dead space.

* * * * *